United States Patent [19]

Scala

[11] Patent Number: 5,005,750

[45] Date of Patent: Apr. 9, 1991

[54] MAGAZINE FOR COMPRESSED-AIR RIVETING GUNS

[75] Inventor: Giancarlo Scala, Bologna, Italy

[73] Assignee: Fasco S.p.A., Cadriano di Granarolo Emilia, Italy

[21] Appl. No.: 441,727

[22] Filed: Nov. 27, 1989

[30] Foreign Application Priority Data

Dec. 2, 1988 [IT] Italy ..... 3688 A/88

[51] Int. Cl.[5] ..... B25C 1/04

[52] U.S. Cl. ..... 227/109

[58] Field of Search ..... 227/109

[56] References Cited

U.S. PATENT DOCUMENTS 3,720,364 3/1973 Maestri ..... 227/109

4,174,802 11/1979 Maestri ..... 227/109

4,304,349 12/1981 Novak et al. ..... 227/109

4,749,115 6/1988 Fehrs ..... 227/109

4,815,647 3/1989 Chou ..... 227/120 X

*Primary Examiner*—Timothy V. Eley

*Attorney, Agent, or Firm*—Guido Modiano; Albert Josif

[57] ABSTRACT

The magazine for compressed-air riveting guns comprises a channel for guiding fastening elements which is delimited by two lateral bars and by a lower lid which can be extracted to allow loading of a set of fastening elements which can be nails, pins, brads, staples. On the side opposite to the lid, the channel is delimited by a strip which can be inserted in one of a plurality of superimposed seats costituted by longitudinal pairs of mutually facing grooves defined in the lateral bars.

4 Claims, 2 Drawing Sheets

MAGAZINE FOR COMPRESSED-AIR RIVETING GUNS

BACKGROUND OF THE INVENTION

The present invention relates to a magazine for compressed-air riveting guns adapted to eject fastening elements of various lengths.

The fastening elements may be nails, pins, brads, staples and the like, and are hereafter generically termed "staples" for ease of description.

Current riveting guns operated with compressed air are constituted by a body which comprises a cylindrical head in which the striking mass is guided and a handgrip which extends perpendicular from said cylinder.

A firing tube is aligned downwardly to the head of the cylinder and has an ejection channel in which the staples to be fired, individually fed from a magazine, are introduced.

The staples are ejected by the striking mass by virtue of a stem which is slidable in the channel and acts axially on the staples.

According to the requirements, the staples have different lengths, and a different magazine is provided for each length. This fact therefore forces the user to avail himself of several guns, each for a single staple length.

It is evident that this requirement entails a considerable economical burden for the user.

SUMMARY OF THE INVENTION

The technical aim of the present invention is therefore to provide a riveting gun magazine which can accomodate sets of staples having different lengths.

Within the scope of the above aim, an object of the present invention is to provide a magazine which is structurally simple despite being adaptable to staples of different lengths.

This aim and this object are achieved by a magazine as defined in claim 1.

BRIEF DESCRIPTION OF THE DRAWINGS

The advantages and characteristics of the present invention will become apparent from the following description of a preferred embodiment, illustrated only by way of non-limitative example in the accompanying drawings. wherein.

DESCRIPTION OF THE PREFERRED EMBODIMENTS

Figure 1:
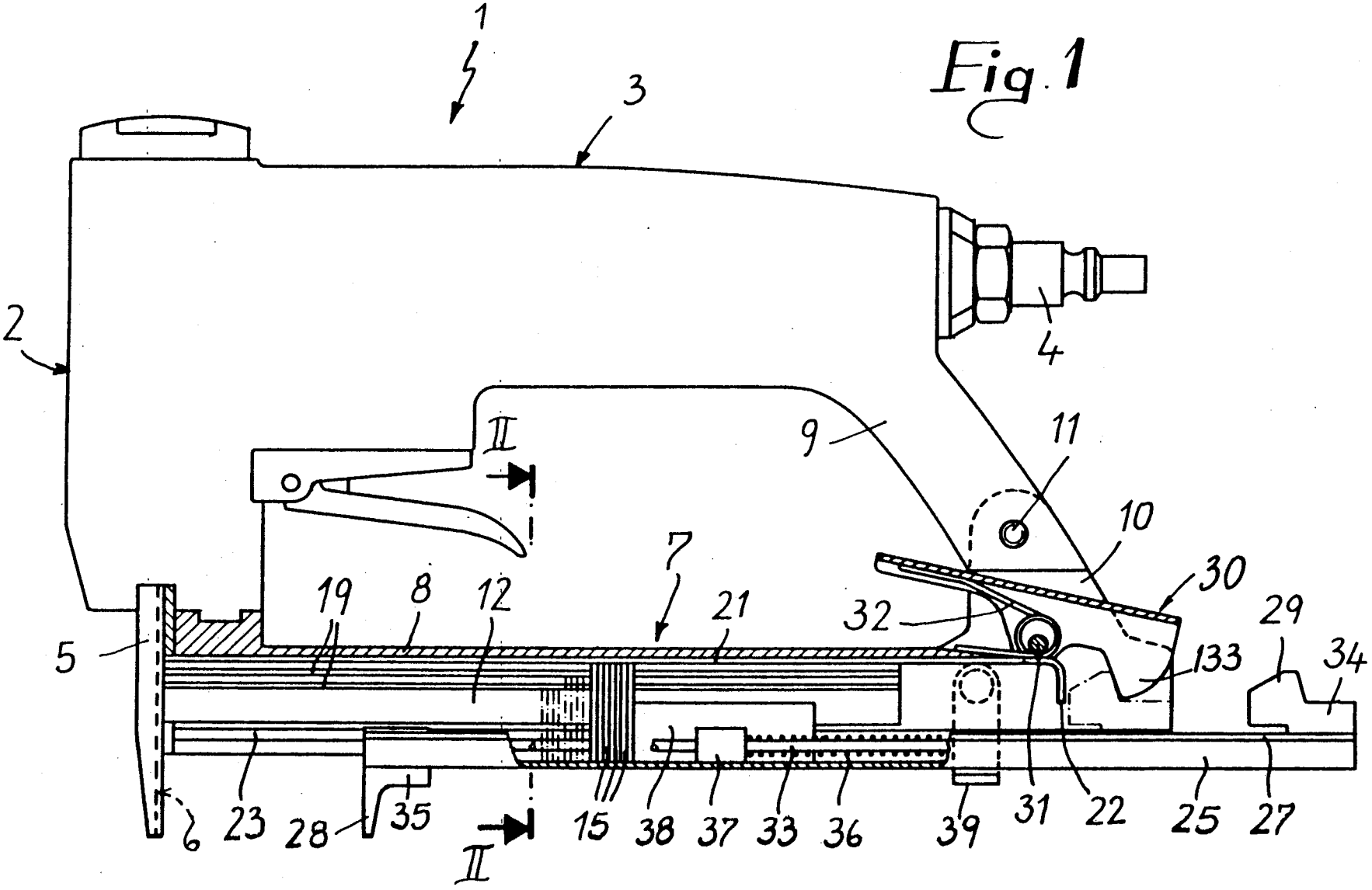
FIG. 1 is a side view of a gun provided with a longitudinally sectioned magazine.

With reference to the above figures, the reference numeral 1 indicated the body of the pneumatic riveting gun which comprises a cylindrical head 2 rigidly associated with a handgrip 3 having. at its end, a connection 4 for coupling to a source of compressed air.

A firing tube 5 extends from head 2 and axially defines a staple ejection channel 6.

The staples are contained in a magazine, generally indicated by the reference numeral 7, which comprises a U-shaped profiled element 8 which is connected with one of its ends to the channel 6 and is coupled, with its opposite end, to an arm 9 which extends from the handgrip 3. In detail, the profiled element 8 has a pair of wings 10 which extend upwardly and are hinged to a terminal portion of the arm 9 through a screw 11.

The profiled element 8 is downwardly open and encloses a cavity in which two adjacent bars or strips 12, 13 are fixed. A channel 14 is defined between side bars 12, 13 and is intended to accommodate the staples to be ejected, which are constituted, in the illustrated example, by pins 15 (also known as brads) which are joined, mutually adjacent, to form a set or stick. The bars 12, 13 are internally fixed to the side walls 16, 17 of the profiled element 8 by screws 18 and have longitudinal grooves 19 and 20 on the mutually opposite faces of bars 12, 13 which delimit the channel 14. Each groove 19 of the bar 12 is arranged level with a groove 20 of the bar 13, so as to form three superimposed guides for a strip 21 which can be inserted therein.

Said strip 21 has a terminal curved grip portion 22 which allows the strip 21 to be removed from a guide and to be inserted in a different guide, according to the length of the pins 15.

The lower edges of the profiled element 8 are widened with respect to the walls 16, 17 and are internally traversed by two respective longitudinal grooves 23, 24 arranged facing one another.

A lid 25 is slidable in said grooves 23, 24 and has a U-shaped cross section, with two edges 26, 27 folded outward to engage in the grooves 23, 24.

The lid 25 has a downwardly protruding beak 28 at one end and an upwardly protruding tooth 29 at the other end. When the lid 25 is completely inserted in the grooves 23, 24, the beak 28 closes the terminal portion of the ejection channel 6 and is kept in said closure position by the engagement of a retention element 30 on the tooth 29.

Figure 2:
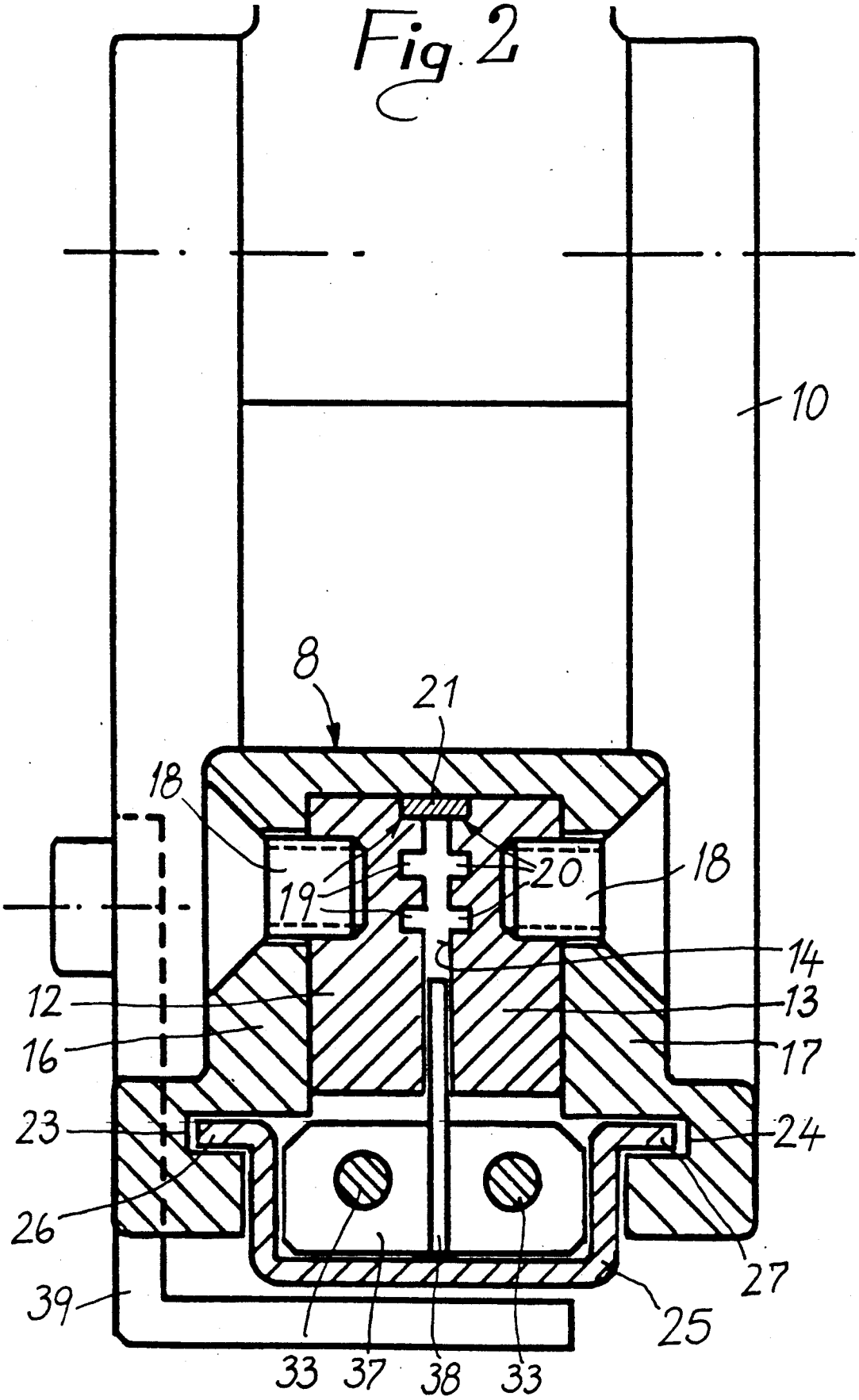
FIG. 2 is a sectional view taken along the plane II—II of FIG. 1.

Said retention element in practice comprises a lever which is pivoted in a rocker-like manner between the wings 10 by means of a pin 31, while a coiled spring 32, wound around pin 31, has an arm **32*a* acting on the lever 30 to rotate it in clock-wise direction (with respect to FIG. 2). The lever has a sort of end cam 133 which, as an effect of the spring 32, acts on the tooth 29 (as shown in dash and dot line in FIG. 1), causing an axial thrust on the lid 25 which keeps said lid in abutment against the tube 5**.

The lid 25 delimits an internal chamber for the accommodation of a pair of parallel rods 33 the opposite ends whereof are fixed in a block 34 defining the tooth 29 and respectively in the coupling block 35 of the beak 28.

Two respective springs 36 are arranged on the rods 33 and act between block 34 and a slider 37 which is slidable on said rods. A staple pusher 38, comprising a lamina arranged in the longitudinal middle plane of the element 8 and slideable in the channel 14, is rigidly associated with said slider.

It should be noted that the block 35 is divided in half by a slot which is co-planar to the channel 14 to allow the passage of the staples pushed therethrough by the staple pusher 38.

The described magazine is completed by a strap 39 which is fixed laterally to the element 8 and is folded so as to define an L below the lid 25 to stop its stroke when it is extracted to insert a new set of pins by abutment of the block 35 against strap 39.

The operation of the described magazine is fully evident from the above description. In particular, in order to load the pins in the channel 14, the user acts on the lever 30 so as to raise the cam 133, disengaging it from the tooth 29.

It is thus possible to pull out the lid 25 until the beak 38 abuts against the strap 39. The channel 14 can thus be accessed for its entire length, allowing to insert therein an entire set of pins, which remains adjacent to the strip 21 its upper longitudinal edge and flush to the lid 25 with its lower edge.

When the lid 25 is closed, the set of pins 15 is thus perfectly guided in the channel 14.

When it is required to use pins of different lengths, the strip 21 is extracted from its seat and is inserted in another one of the seats defined by the opposite grooves 19, 20 so that the distance between the strip 21 and the lid 25 coincides with the length of the pins, allowing said pins to advance without play toward the ejection channel 6.

The described invention is susceptible to numerous modifications and variations, all of which are within the protective scope. In particular, the cross section of the channel 14 can be modified according to the shape of the staples to be fired.

I claim:

1. A magazine for compressed-air riveting guns, comprising a staple guiding channel delimited by two opposed side faces, a lid which can be extractable to allow loading of a set of staple elements, a plurality of seats formed by pairs of mutually facing longitudinal grooves extending in said faces at a side of said channel opposite to said lid, and a strip which can be inserted in one of said plurality of seats, said staple guiding channel being defined between two opposite bars fixed in a cavity enclosed by a U-shaped profiled element, said bars defining said pairs of mutually facing grooves for inserting said strip upon extraction of said lid.

2. A magazine according to claim 1, wherein said U-shaped profiled element has two protruding arms each defining, at an end portion thereof, a respective longitudinal groove, said longitudinal grooves facing each other and slidably engaging said lid.

3. A magazine according to claim 1, wherein said lid has a protruding tooth engaging with a spring-biased lever hinged to said profiled element.

4. A magazine for riveting gun tool, comprising a fastening element guiding channel means defined by two opposite side faces, a lid means which can be extracted to allow loading of fastening elements, and a fastening element pusher means for engaging the fastening elements accommodated in said guiding element means, wherein longitudinal groove means are provided in said faces, said longitudinal groove means defining a plurality of seat means for removably accommodating an insertable strip means, whereby said insertable strip means are removably insertable in one of said plurality of seat means depending upon the fastening element sise.

* * * * *